United States Patent [19]

Horen

[11] 4,382,571

[45] May 10, 1983

[54] SCAFFOLD BRACKET AND HANGER THEREFOR

[76] Inventor: David J. Horen, 636 Kings Grant Rd., Virginia Beach, Va. 23452

[21] Appl. No.: 218,978

[22] Filed: Dec. 22, 1980

[51] Int. Cl.[3] ..... A47G 29/02

[52] U.S. Cl. ..... 248/235; 182/82

[58] Field of Search ..... 248/235, 239, 242, 243, 248/247, 248, 222.4; 182/83, 87, 82; 108/108

[56] References Cited

U.S. PATENT DOCUMENTS

| | | | |
|---|---|---|---|
| 1,541,971 | 6/1925 | Lampert | 248/354 P X |
| 2,916,245 | 12/1959 | Williams | 248/242 |
| 3,035,805 | 5/1962 | Blank | 248/354 P |
| 3,158,225 | 11/1964 | Almgren | 248/235 X |
| 3,164,255 | 1/1965 | Jay | 211/193 X |
| 3,332,655 | 7/1967 | Van Buren | 248/235 |
| 3,432,134 | 3/1969 | Forschmidt | 248/235 |
| 3,525,442 | 8/1970 | Novales | 211/193 |
| 3,848,851 | 11/1974 | Elias | 248/354 P X |
| 3,905,572 | 9/1975 | Hikai | 248/242 |
| 4,023,684 | 5/1977 | Saul | 211/193 |

FOREIGN PATENT DOCUMENTS

| | | | |
|---|---|---|---|
| 330060 | 5/1958 | Switzerland | 248/242 |
| 1226386 | 3/1971 | United Kingdom | 211/193 |

*Primary Examiner*—J. Franklin Foss

*Attorney, Agent, or Firm*—Sughrue, Mion, Zinn, Macpeak and Seas

[57] ABSTRACT

A scaffolding bracket for supporting a platform against the wall of a ship or the like has a tapered U-shaped support beam having opposed pairs of apertures in the sides near one end thereof, the support beam is adjustable relative to a wall engaging plate. The wall engaging plate has a pair of keyhole apertures which connect to a pair of metallic studs which are secured to the wall of the ship or the like by welding means. The plate has a flange, the opposed sides of which define a segment of a circle about which the support beam is adjustably pivoted. The flange has a series of apertures at spaced apart intervals which cooperate with the pairs of apertures near the end of the support beam thus allowing the support beam to be pivotably adjusted in increments of five or ten degrees around the circle segment. In order to permit the bracket to be used on the inside wall as well as the outside wall of a ship, the flange is constructed to define a half circle about which the support beam is adjustably pivoted by a series of spaced apertures therein.

10 Claims, 10 Drawing Figures

SCAFFOLD BRACKET AND HANGER THEREFOR

BACKGROUND OF THE INVENTION

1. Field of the Invention

This invention relates to a scaffold bracket of the type used to support workmen working on the outside and inside walls of a ship, container or tank constructions. The bracket is adjustable in increments so that the support beam may be maintained horizontal relative to the vertical axis of the ship, container or tank.

2. Statement of the Prior Art

The prior art shows brackets for supporting scaffolding. The brackets are hung over nails driven into wooden members. Unlike the present invention, the prior art does not disclose a bracket adjustable along a circle segment and hung on studs attached to a ship wall. Patents relating to this field of invention include the following U.S. patents:

| Patentee | U.S. Pat. No. | Issue Date |
|---|---|---|
| E. F. Wendt | 945,428 | Jan. 4, 1910 |
| J. A. Macdonald | 1,722,529 | July 30, 1929 |
| F. O. Ingerman | 2,321,916 | June 15, 1943 |
| H. S. Van Buren, Jr. | 3,332,655 | July 25, 1967 |
| S. Forschmidt | 3,432,134 | March 11, 1969 |
| Johansson | 3,957,240 | May 18, 1976 |

SUMMARY OF THE INVENTION

This invention provides a bracket which may be utilized anywhere cantilevered scaffolding is used on metallic walls and like constructions. It finds particular application in ship-building where it is necessary for workmen to perform various operations on the inside and outside walls of the ship.

Therefore, it is one object of this invention to provide a bracket which is simple to manufacture, and may be installed with a minimum amount of labor and skill.

It is a further object of this invention to provide a bracket which will permit pivotable adjustment of the work platform support beam so that the support beam may be maintain in a horizontal position relative to the vertical axis of the ship, regardless of the angle of inclination of the ship's walls.

A still further object of this invention is to provide a bracket whereby the support beam may be adjusted in variable increments, for example, increments of five or ten degrees, about a circle segment.

DESCRIPTION OF THE PREFERRED EMBODIMENT

Figure 6:
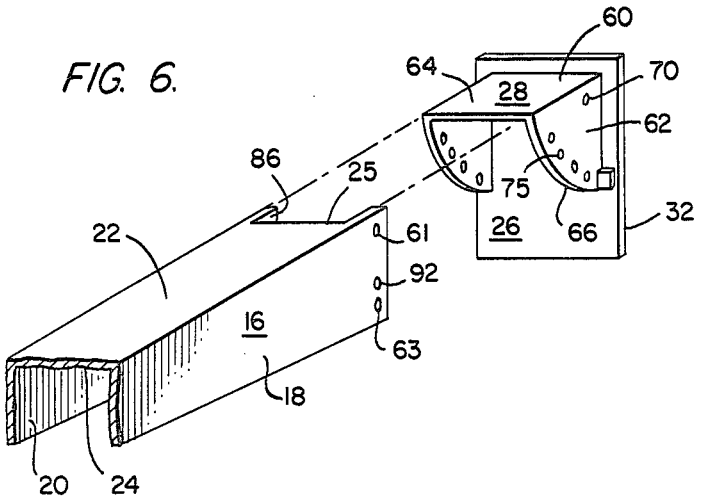
FIG. 6 is an exploded view of the bracket showing the support beam, and support beam plate with an apertured flange secured to said plate.
Figure 7:
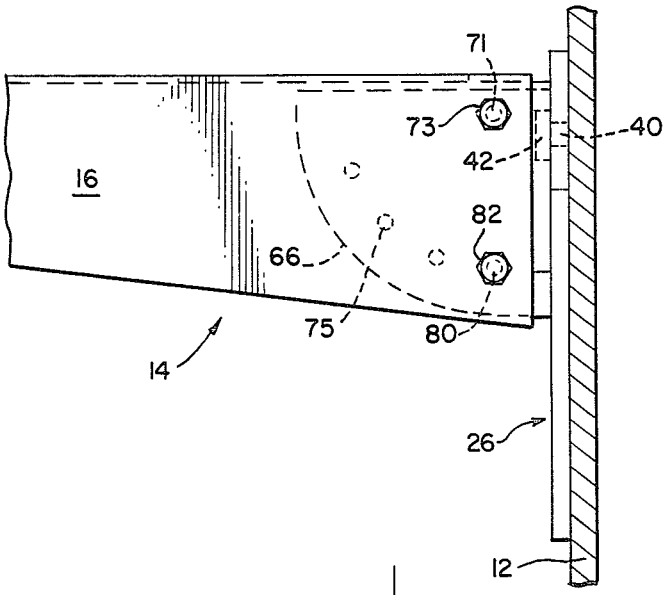
FIG. 7 is a cut away view of the bracket showing the means by which the support beam may be adjusted relative to the support plate and flange.

Referring to the drawings in more detail, a scaffold 10 is shown supported on a vertical wall 12 by a scaffold bracket 14. The scaffold bracket 14 is of U-shaped cross section and comprises a support beam 16 having a side walls 18 and 20 and a top wall 22. The U-shaped support beam is tapered from the narrow end 24 to the wide end 26. Pairs of apertures 61, 63 and 92 are provided in the side walls of the beam near the wide end 26, FIG. 6.

Support plate 26 has a front wall 30, and outer periphery 32 and back wall 34. A pair of keyhole slots 36 are cut in the support plate which functions to connect the support plate to the wall 12 of any metallic construction, usually steel. This attachment is accomplished by the use of studs 38 of steel or other suitable metal having a shank portion 40 and an enlarged head 42. The studs are attached to the wall 12 by an electric welding gun and are positioned in aligned pairs corresponding to the pairs of keyhole slots in the support plate. The studs 38 are spaced in horizontal aligned pairs along the wall, and as can be readily seen, the brackets are attached to the wall 12 by hanging the support plates on the studs 36. By attaching a series of brackets horizontally along the wall 12, planks 10 or a like platform may be laid over the support beams thus providing a scaffold for supporting workmen adjacent the side of a ship, container, or other like construction.

Instead of using the keyhole slots 36 and headed studs 38, circular holes 50 may be punched through the support plate 26 and aligned pairs of headless studs 52 having threaded ends 54 are used instead of the headed studs. In this regard, the headless studs are welded in pairs to the wall and the bracket fastened to said pairs of studs by nuts 56.

The support beam 16 has a pair of opposed apertures 61 located on the upper corners of sides 18 and 20 near the wide end 25 thereof. A similar pair of opposed apertures 63 are located on the lower corners of side walls 18 and 20 near wide end 25, FIG. 6. Between opposed pairs 61 and 63 an additional pair of opposed apertures 92 are provided to facilitate fine adjustment of the support beam relative to the support plate. In order to facilitate incremental adjustment of the support beam 16 relative to the support plate 26, the plate is provided with a forwardly projecting flange 28 having a top wall 60, depending side walls 62, front edge 64 and arcuate edges 66. The flange 28 has a pair of opposed apertures 70 in the upper corners of the side walls 62 adjacent the support plate 26. The end 25 of the support beam is slightly wider than the width of the flange 28 so as to permit end 25 to telescope over the flange. The apertures 61 of the support beam are aligned with the pair of apertures 70 of the flange and a bolt 71 and a nut 73 secures the support beam 16 pivotally to the flange 26.

Figure 1:
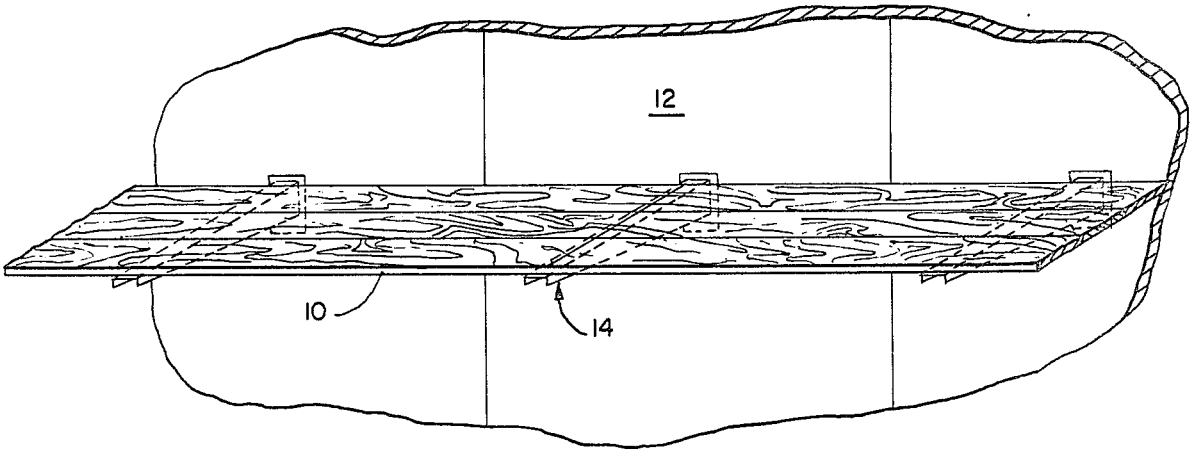
FIG. 1 is a perspective view of a scaffold bracket cantilevered from a vertical wall according to this invention.
Figure 3:
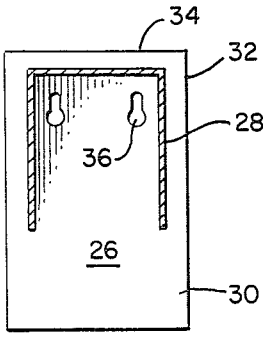
FIG. 3 is a view taken along the line 3—3 of FIG. 2 and shows the keyhole slots in the support plate.
Figure 2:
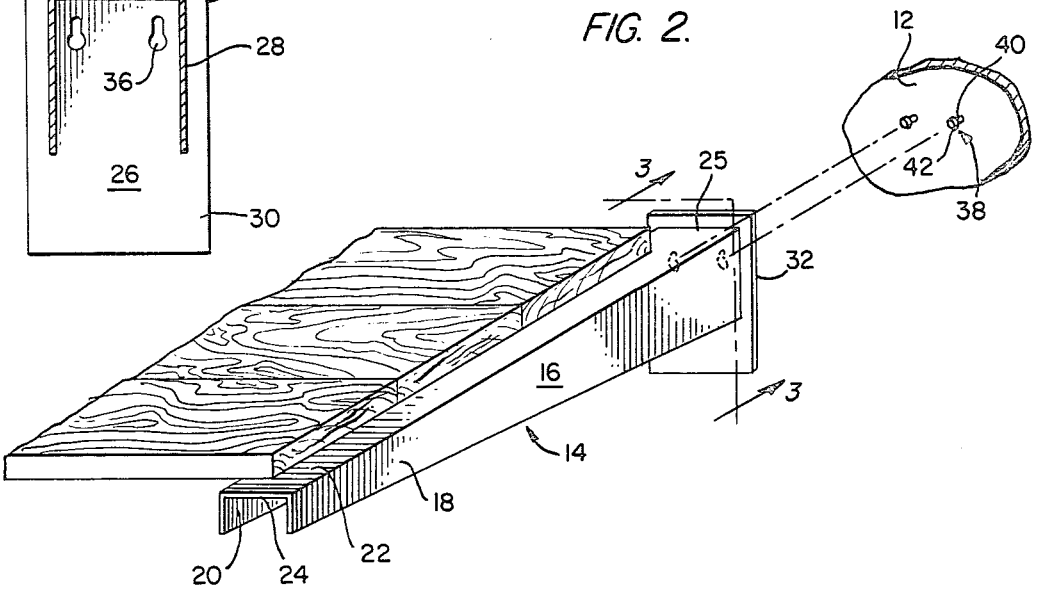
FIG. 2 is a perspective view of the support beam, support plate with keyhole slots and the steel studs which serve as a hanger for the scaffold bracket.
Figure 4:
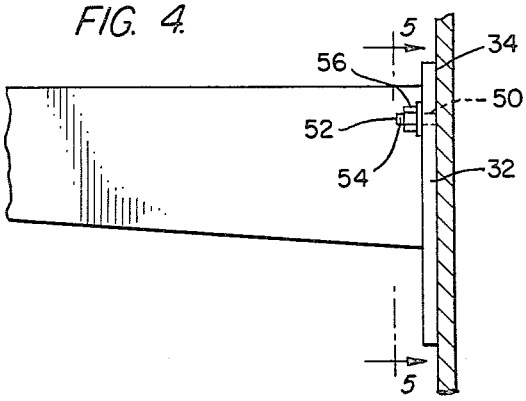
FIG. 4 is a side view of the bracket attached to a wall of a ship or the like by nuts threaded onto the ends of the studs.
Figure 5:
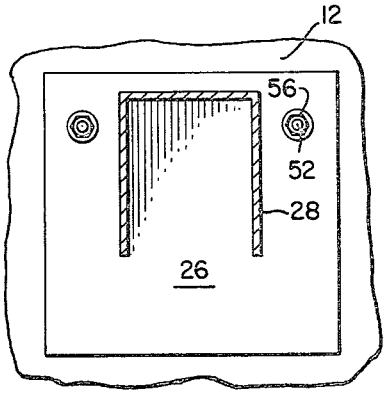
FIg. 5 is a view taken along the line 5—5 of FIG. 4 and shows the support plate secured to the steel wall by hanging same on the studs.

The flange 28 has a series of opposed apertures 75 in the side walls 62 adjacent to the arcuate edges 66. The apertures 75 are arranged in an arcuate contour following the curvature of edges 66 and are spaced at intervals from each other, ideally at ten degree intervals. When the bracket is used on a vertical wall 12, FIG. 2, the support beam 16 is maintained horizontal relative to the support plate 26 by securing the beam to the flange by inserting a bolt 80 through the lower pair of apertures 63 and the lower most pair of opposed apertures in the series 75 of the flange. A nut 82 secures the bolt 80 to the flange.

Figure 8:
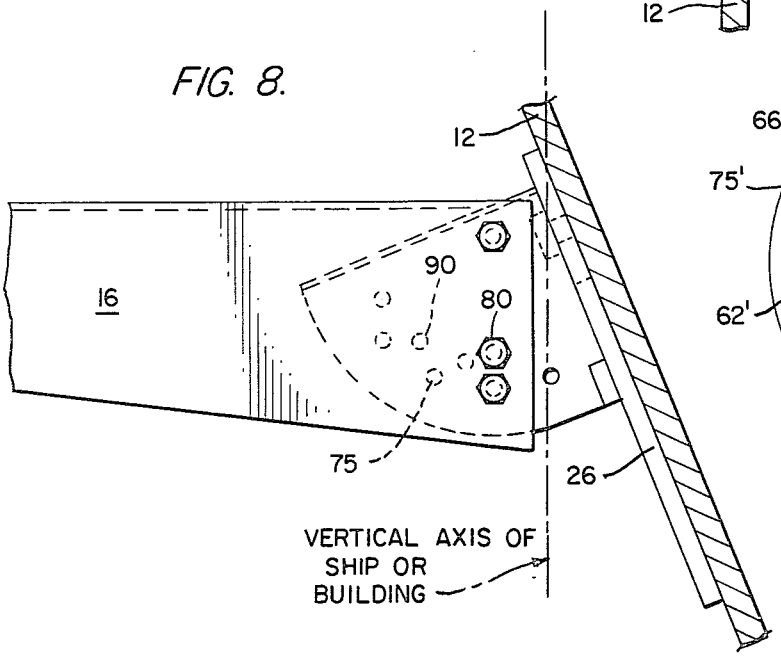
FIG. 8 is a cut away view of the bracket showing the bracket attached to an oblique wall and the support beam adjusted so that it is maintained horizontal relative to the vertical axis of the ship.

The support beam may be adjusted incrementally about the flange 26 by aligning the lower pair of opposed apertures 63 with any pair of opposed apertures in the arcuate series 75. FIG. 8 shows the support plate 26 attached to an oblique wall 12 of a ship or other steel construction. In order to maintain the support beam 16 horizontally relative to the vertical axis 84 of the ship or other building, it is only necessary to align the aperture 63 of the support beam 16 with the appropriate opposed pair in the arcuate series 75. A slot 86 is cut in the top wall 22 of the support beam 16 adjacent the wide end 25 so that the beam is free to pivot about the pivot axis of nut 71. Since the apertured series 75 are spaced at intervals of ten degrees in an arcuate path adjacent the arcuate edges 66, the support beam may be incrementally adjusted accordingly.

In order to permit finer adjustment of the support beam 16 relative to the support plate 26, a second series of opposed apertures 90 inward and offset from the series 75 are provided at, for example, ten degree intervals from each other, FIG. 8. To this end, the first and second pairs of apertures 63 and 92 are used alternatively with the first and second series 75 and 90 so as to obtain adjustments of five degrees. For example, to achieve an adjustment of five degrees rather than ten degrees, it is only necessary to reposition the bolt 80 from the apertures 63 and the series apertures 75 to the apertures 92 and the appropriate opposed pair of the series 90. By this construction, the bracket may be used on very steeply inclined walls, yet with the assurance that the support beam 16 may be adjustable so as to maintain the support beam horizontal relative to the vertical axis of the ship or other building under consideration.

Figure 9:
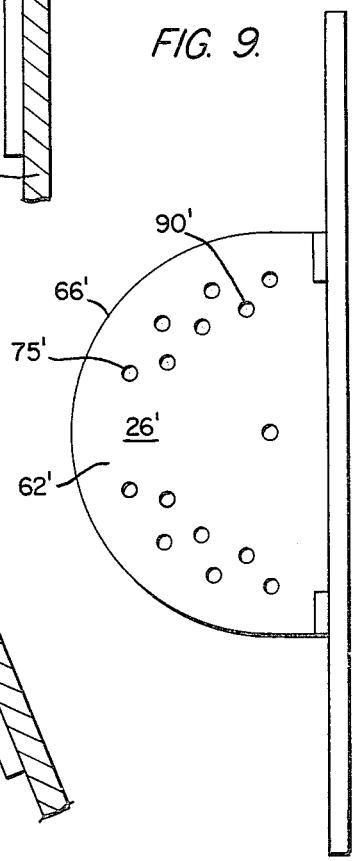
FIG. 9 is a view of the bracket showing the flange as semi-circular.
Figure 10:
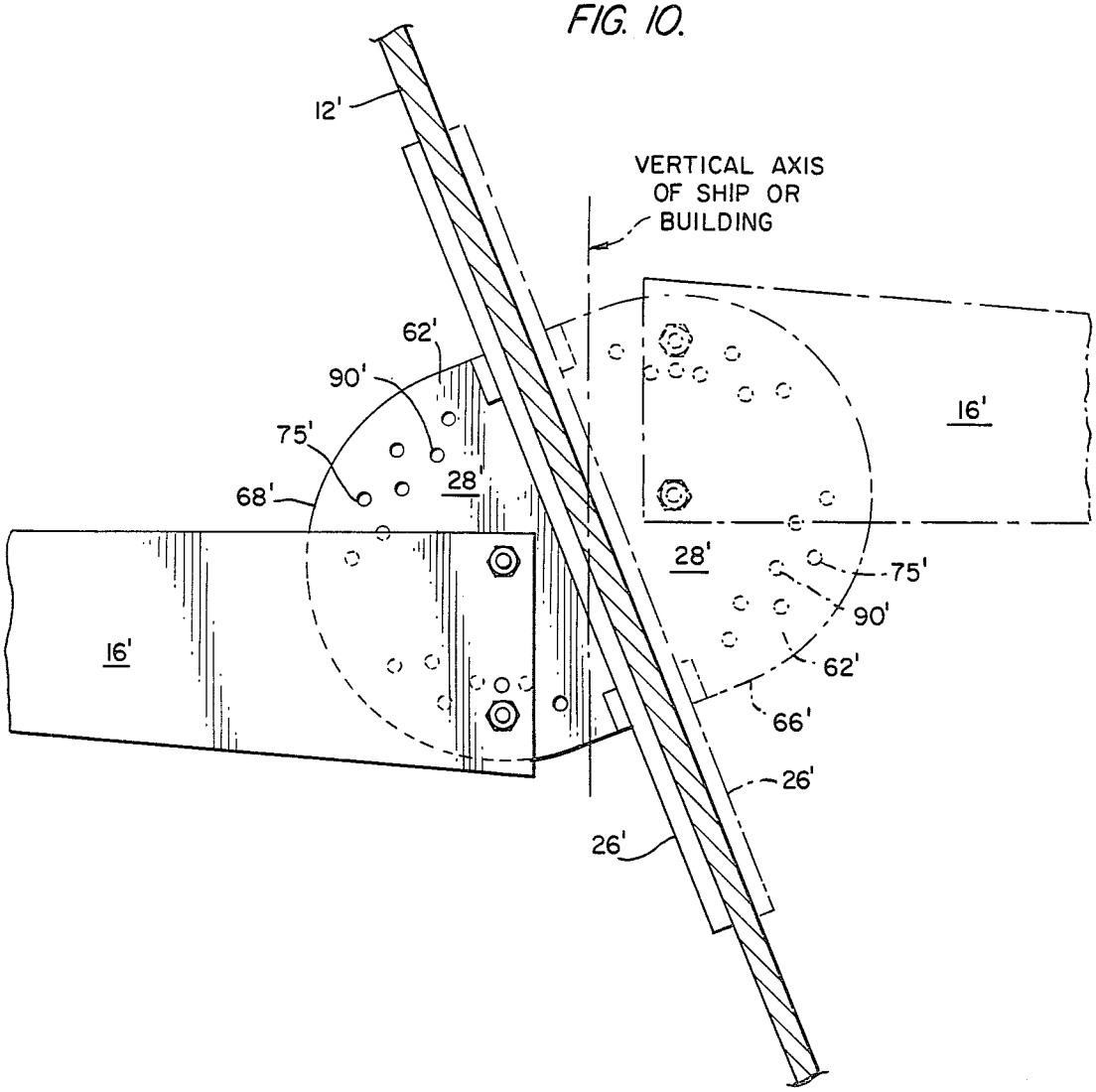
FIG. 10 is a further view of the bracket mounted on the inside and outside walls of a ship with the support beam adjustable along the semi-circular flange so that the support beam is maintained horizontal relative to the vertical axis of the ship, the wall of which is shown to be at an oblique angle.

It is often necessary to perform certain operational functions on the inside walls of a ship or other steel container or building. The bracket as shown in FIGS. 9 and 10 is utilized to this end. The flange 28' is modified to include semi-circular side walls 62'. A first series of apertures 75' are arranged about the semi-circular flange adjacent to the semicircular edges 66'. A second series of apertures 90' are positioned inward and offset of the first series 75'. This construction permits the bracket to be used either on the outside or inside walls of a ship or other structure.

In FIG. 10, the bracket is attached to outside and inside oblique walls 12' of a ship or the like and the support beam 16' is adjusted relative to the support plate 26' by use of either the inside or outside series of apertures 75' or 90'. As can be readily understood, the support beam 16' may be adjusted along the semi-circular flange 28' in increments of five or ten degrees. Since the flange is semi-circular in configuration, the bracket is readily adaptable for use on both the inside and outside oblique walls 12' of a ship or the like by merely reversing the bracket 180 degrees and adjusting the support beams 16' along the semi-circular flange to obtain a horizontal orientation for said beam.

While the invention has been particularly shown and described with reference to a preferred embodiment thereof, it will be understood to those skilled in the art that various changes in form and details may be made therein without departing from the spirit and scope of the invention.

What I claim is:

1. A scaffold bracket for the curved steel wall of a ship or the like, comprising:

a support beam having a U-shaped cross-section and tapering in width from end to end;

a support plate having a pair of key-hole slots positioned in spaced relationship in a horizontal plane;

said support beam being rigidly secured at its widest end to said support plate a distance inward of its periphery with the widest end circumscribing said key-hole slots;

said slots in said plate being positioned below and in close proximity to the top flange of said support beam;

pairs of parallel steel studs welded to the curved steel wall of the ship for supporting said support U-beam and support plate against said wall whereby a plurality of planks forming a platform for supporting workers and equipment may be supported on said support U-beam and studs whereby workers may perform work on the curved said wall of said ship.

2. A support bracket for the curved steel wall of a ship comprising:

a support plate;

an outwardly projecting flange welded to said support plate a distance inward of the edges of said plate;

a support U-beam pivotable on said flange on a horizontal pivot axis extending through said flange and said U-beam whereby said U-beam may pivot on said horizontal pivot axis relative to said flange;

apertures in said flange cooperating with apertures in said U-beam further cooperating with securing means for permitting adjustment of said support U-beam relative to said support plate;

pairs of slots in said support plate; and pairs of studs welded to a steel wall of a ship whereby said support plate and said support U-beam are removably attached to said steel wall of said ship whereby a platform may be supported on said U-beam for supporting workers and equipment adjacent the wall of said ship.

3. A scaffold bracket as defined in claim 2, wherein:

said flange comprises a top wall, side walls and arcuate edges and a plurality of apertures in said side walls arranged in an arcuate pattern adjacent said arcuate edges.

4. A scaffold bracket as defined in claim 2, wherein:

said pairs of slots are keyhole in shape and said pairs of studs are headed whereby said U-beam may be removably attached to the steel wall of a ship.

5. A scaffold bracket as defined in claim 2, wherein:

said slots are circular and said studs are threaded to receive nuts to secure said support plate and said support beam to said wall.

6. A scaffold bracket as defined in claim 2, wherein:

said means for permitting adjustment of said support beam relative to said support plate comprises first and second pairs of opposed apertures on said support beam, first and second series of apertures on said flange arranged in arcuate paths, said first pair of opposed apertures being aligned with any one of said first series of apertures and said second pair of opposed apertures being aligned with any one of said second series of apertures and a bolt passed through either of said first or said second pairs of opposed apertures and either of selected ones said first series or said second series of apertures.

7. A scaffold bracket as defined in claim 6, and:

said bolt being passed through said first pair of opposed apertures and selective ones of said first series of apertures permitting incremental adjustment.

8. A scaffold bracket as defined in claim 6, and:

said bolt being passed through said second pair of opposed apertures and selected ones of said second series of apertures permitting incremental adjustments of five degrees.

9. A scaffold bracket as defined in claim 6, and:

said bolt being passed through said second pair of opposed apertures and selected ones of said second series of apertures permitting incremental adjustments of ten degrees.

10. A scaffold bracket as defined in claim 2, wherein:

said flange is semi-circular and said means for permitting adjustment of said support beam relative to said support plate comprises first and second pairs of opposed apertures in said support beam, first and second series of apertures on said semi-circular flange, said first and second series of apertures being spaced and offset from each other and arranged in semi-circular fashion on said flange and a bolt passed through either said first or said second pairs of opposed apertures and through a selected one of either said first or said second series of apertures to permit adjustment of said support beam relative to said support plate in increments of five and ten degrees.

* * * * *